US008931562B2

(12) United States Patent
Cargol, Jr. et al.

(10) Patent No.: US 8,931,562 B2
(45) Date of Patent: Jan. 13, 2015

(54) COLLECTOR FOR CAPTURING FLOW DISCHARGED FROM A SUBSEA BLOWOUT

(75) Inventors: Patrick Michael Cargol, Jr., The Woodlands, TX (US); Robert H. Gatliff, Jr., Houston, TX (US); Pierre Albert Beynet, Houston, TX (US); Kevin James Devers, Katy, TX (US); Trent J. Fleece, Houston, TX (US); Norman Dennis McMullen, Cypress, TX (US); Jason T. Holvey, Montgomery, TX (US); Jonathan Eryl Rogers, The Woodlands, TX (US); Daniel Scott Stoltz, The Woodlands, TX (US)

(73) Assignees: Wild Well Control, Inc., Houston, TX (US); BP Corporation North America Inc., Houston, TX (US)

( * ) Notice: Subject to any disclaimer, the term of this patent is extended or adjusted under 35 U.S.C. 154(b) by 180 days.

(21) Appl. No.: 13/237,549

(22) Filed: Sep. 20, 2011

(65) Prior Publication Data

US 2012/0125623 A1 May 24, 2012

Related U.S. Application Data

(60) Provisional application No. 61/384,358, filed on Sep. 20, 2010.

(51) Int. Cl.
*E21B 43/01* (2006.01)

(52) U.S. Cl.
CPC ..... *E21B 43/0122* (2013.01)
USPC ..... 166/344; 166/345; 166/363; 166/364; 166/367

(58) Field of Classification Search
USPC ..... 166/368, 367, 341, 342, 363–364, 166/75.13; 405/158, 166; 114/44, 45; 414/138.2, 138.4
See application file for complete search history.

(56) References Cited

U.S. PATENT DOCUMENTS

| | | | | | |
|---|---|---|---|---|---|
| 1,830,061 | A | * | 11/1931 | Howe | 166/79.1 |
| 4,318,442 | A | * | 3/1982 | Lunde et al. | 166/357 |
| 4,323,118 | A | * | 4/1982 | Bergmann | 166/96.1 |
| 4,358,218 | A | * | 11/1982 | Graham | 405/60 |
| 4,421,436 | A | | 12/1983 | Burns | |
| 4,456,071 | A | * | 6/1984 | Milgram | 166/356 |
| 4,531,860 | A | * | 7/1985 | Barnett | 405/60 |

(Continued)

FOREIGN PATENT DOCUMENTS

| | | | | |
|---|---|---|---|---|
| GB | 2055414 | A * | 3/1981 | B63B 35/32 |
| WO | 2012148993 | A2 | 11/2012 | |

OTHER PUBLICATIONS

BP—"Deepwater Horizon Containment and Response: Harnessing Capabilities and Lessons Learned," BP report dated Sep. 1, 2010, 46 pages.

(Continued)

*Primary Examiner* — James G Sayre
(74) *Attorney, Agent, or Firm* — Patterson & Sheridan, L.L.P.

(57) ABSTRACT

A collector for capturing flow discharged from a subsea blowout includes a tubular housing having a containment chamber; a seal connected to the housing; a tubular chimney connected to the housing, having a portion of a subsea connector, and having a diameter less than a diameter of the containment chamber; and a head connected to the housing and the chimney.

30 Claims, 8 Drawing Sheets

(56) References Cited

U.S. PATENT DOCUMENTS

| | | | | |
|---|---|---|---|---|
| 4,568,220 | A * | 2/1986 | Hickey | 405/60 |
| 4,619,762 | A * | 10/1986 | Delacour et al. | 210/170.11 |
| 2005/0025574 | A1 | 2/2005 | Lazes | |
| 2011/0274493 | A1 * | 11/2011 | Cutts | 405/60 |
| 2011/0274496 | A1 * | 11/2011 | Dvorak | 405/64 |
| 2012/0018165 | A1 | 1/2012 | Crossley et al. | |
| 2012/0055573 | A1 * | 3/2012 | Adams | 138/89 |
| 2012/0160509 | A1 * | 6/2012 | Caldwell et al. | 166/363 |
| 2012/0201604 | A1 | 8/2012 | Drieu et al. | |

OTHER PUBLICATIONS

Corum, Jonathan, et al.—"Methods That Have Been Tried to Stop the Leaking Oil," The New York Times article updated Aug. 17, 2010, 11 pages.

Dlouhy, Jennifer A.—"BP says spill battle advanced technology," Houston Chronicle article dated Sep. 2, 2010, 1 page.

Krauss, Clifford, et al.—"Acrimony Behind the Scenes of Gulf Oil Spill," The New York Times article dated Aug. 26, 2010, 8 pages.

Lyons, William C., et al.—"4.21 Offshore Drilling Operations," Standard Handbook of Petroleum & Natural Gas Engineering, Second Edition, Gulf Professional Publishing, an imprint of Elsevier, Inc., copyright 2005, pp. 4-558-4-565.

Oil & Gas UK—"Secretary of State Views Enhancements to UK Oil Spill Response Capability," press release dated Oct. 8, 2010, The United Kingdom Offshore Oil and Gas Industry Association trading as Oil & Gas UK, 3 pages.

PCCI Marine and Environmental Engineering—"Oil Spill Containment, Remote Sensing and Tracking for Deepwater Blowouts: Status of Existing and Emerging Technologies," Final Report dated Aug. 12, 1999, funded by the U.S. Minerals Management Service, 121 pages.

TH-2-TH-7 and TH-10 collector prototypes as of Jun. 9, 2010.

* cited by examiner

COLLECTOR FOR CAPTURING FLOW DISCHARGED FROM A SUBSEA BLOWOUT

CROSS-REFERENCE TO RELATED APPLICATIONS

This application claims benefit of U.S. Provisional App. No. 61/384,358, filed Sep. 20, 2010, which is hereby incorporated by reference in its entirety.

BACKGROUND OF THE INVENTION

1. Field of the Invention

Embodiments of the present invention generally relate to a collector for capturing flow discharged from a subsea blowout.

2. Description of the Related Art

Bringing an underwater well blowout under control is difficult since it is usually accompanied by hydrocarbons and/or fire at the surface and damage to the subsea equipment connector. This uncontrolled flow of crude oil and/or natural gas is not only a waste of energy but also can be a source of water and beach pollution. Control of the well flow from a blowout and collection of oil spills therefrom have been handled separately. Control of well flow is attempted by drilling separate wells to feed heavy mud into the flowing well to kill the flow.

SUMMARY OF THE INVENTION

Embodiments of the present invention generally relate to a collector for capturing flow discharged from a subsea blowout. In one embodiment, a collector for capturing flow discharged from a subsea blowout includes a tubular housing having a containment chamber; a seal connected to the housing; a tubular chimney connected to the housing, having a portion of a subsea connector, and having a diameter less than a diameter of the containment chamber; and a head connected to the housing and the chimney.

In another embodiment, a method for capturing flow discharged from a subsea blowout includes: lowering a collector from a mobile offshore drilling unit (MODU) onto a seafloor at a location distant from subsea equipment blowing production fluid; connecting a workstring to the collector; injecting an inert gas through the workstring; moving the MODU and connected collector to the subsea equipment and landing the collector onto the equipment while maintaining injection of the inert gas; halting injection of the inert gas; and routing a top of the workstring to surface collection equipment, thereby directing the blowing production fluid from the subsea equipment into a chimney of the collector, wherein the chimney is connected to the MODU by the workstring.

In another embodiment, a method for collecting seepage from a seafloor includes: lowering a collector from a mobile offshore drilling unit (MODU) onto the seafloor at a location distant from the seepage; connecting a workstring to the collector; injecting an inert gas through the workstring; moving the MODU and connected collector to the seepage and landing the collector into the seafloor around the seepage while maintaining injection of the inert gas; halting injection of the inert gas; and collecting the seepage from the seafloor to the MODU via the collector and workstring.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
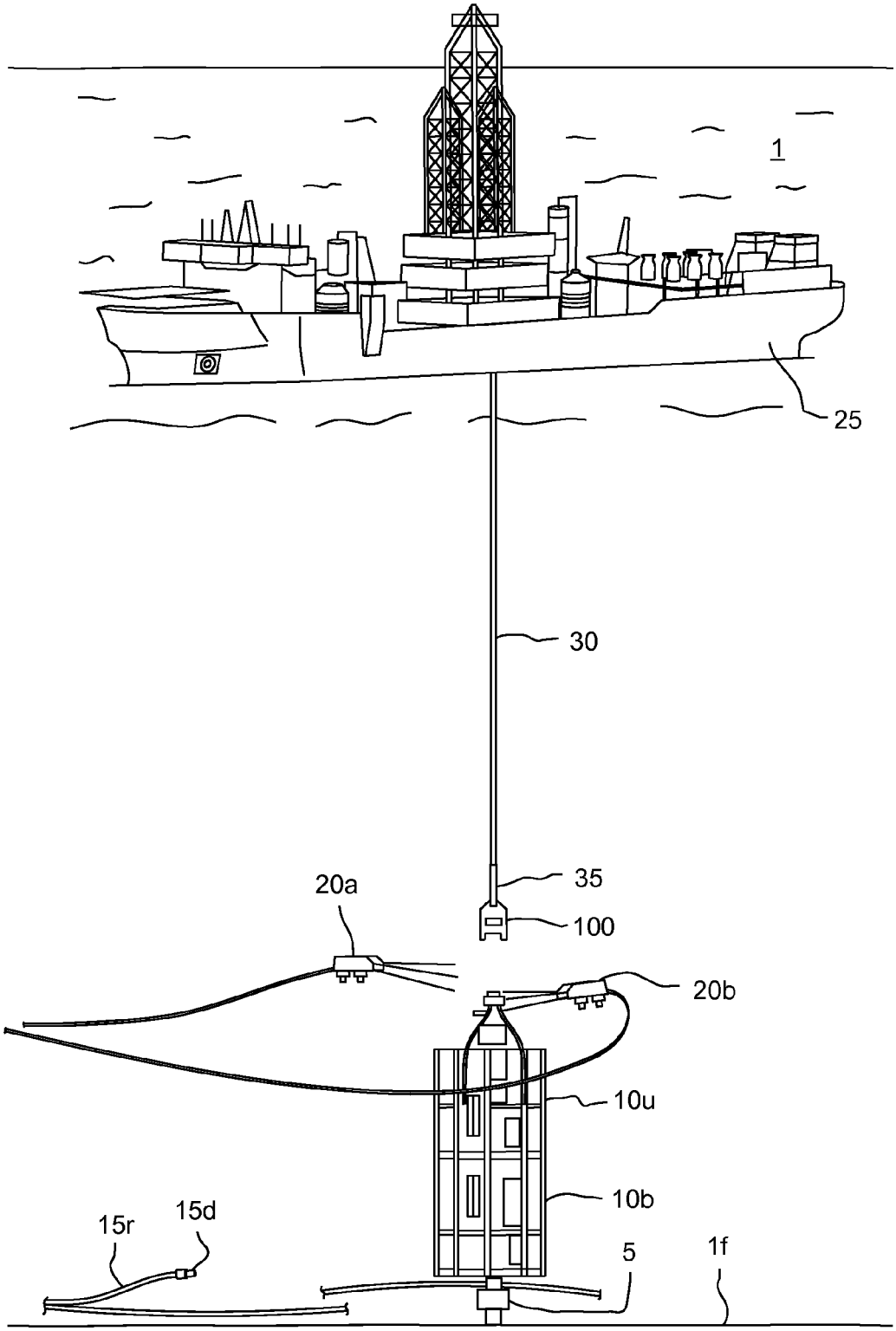
FIG. 1 illustrates lowering a collector to a subsea wellhead having a blowout, according to one embodiment of the present invention.

FIG. 1 illustrates lowering a collector 100 to a subsea wellhead 5 having a blowout 50 (FIG. 1A), according to one embodiment of the present invention. As shown, the well is a subsea well, such as having a wellhead 5 located below the water 1. The blowout preventer (BOP) 10*b* has malfunctioned and failed to contain the blowout 50. The mobile offshore drilling unit (MODU) (not shown) may have burned and sunk to the seafloor. The drilling riser 15*r* may still be attached to the lower marine riser package (LMRP) 10*u* (riser already cut as shown). A drillstring 15*d* or workstring may reside within the riser 15*r*, depending on the operation that caused the blowout 50. Alternatively, the collector 100 may be deployed to control a subsea hydrocarbon release from any other type of subsea equipment, such as a production (aka Christmas) tree.

To prepare the well for installation of the collector 100, the riser 15*r*, drill string 15*d*, and/or workstring may be cut and cleared from the wellhead 5 using one or more remotely operated vehicles (ROVs) 20*a,b*. A MODU, such as a drillship 25 or semi-submersible, may be deployed a safe distance from the blowing well. The collector 100 may be lowered to the seafloor 1*f* by a winch or crane of the MODU 25 or by a workstring 30, such as drill pipe, flexible pipe, or coiled tubing. If the winch or crane was used for deployment, the workstring 30 may then be assembled and connected to the collector 100. The collector 100 may be fastened to the workstring 30, such as by a quick latch 212 (FIG. 2A, only profile shown) or subsea hydraulic connector. The quick latch may be a J-latch 212 and may be operated from the MODU 25 by manipulation of the workstring 30. The collector 100 may have the female portion 212 of the J-latch and the workstring 30 may have the male portion (not shown) or vice versa. The workstring 30 may have an adapter 35 connected to a bottom thereof. The adapter 35 may include a tubular body having a threaded end for connection to the workstring, such as a pin or box, a seal disposed around an outer surface of the tubular body for engaging a seal bore of the collector, a guide nose, and one or more lugs connected to the body, such as with fasteners, and extending from an outer surface of the body.

The lugs may engage respective J-slots 212 formed in an outer surface of a chimney 110 (FIG. 1A) of the collector, thereby forming the J-latch connection.

Alternatively, the collector 100 may be connected to the workstring 30 by a threaded or flanged connection. Alternatively, the collector 100 may be connected to the workstring 30 on the MODU 25 before deployment into the sea 1. Alternatively, the workstring 30 may be insulated to discourage gas hydrates formation. Alternatively, a light intervention vessel may be deployed and the collector may be connected to the vessel by coiled tubing. Additionally, the workstring 30 may include a heave compensator, such as a telescopic joint, to isolate the collector from heave or vertical displacement of the MODU. Alternatively, the workstring 30 may also be connected to the surface vessel or MODU with a conventional heave compensator or draw works.

Figure 1A:
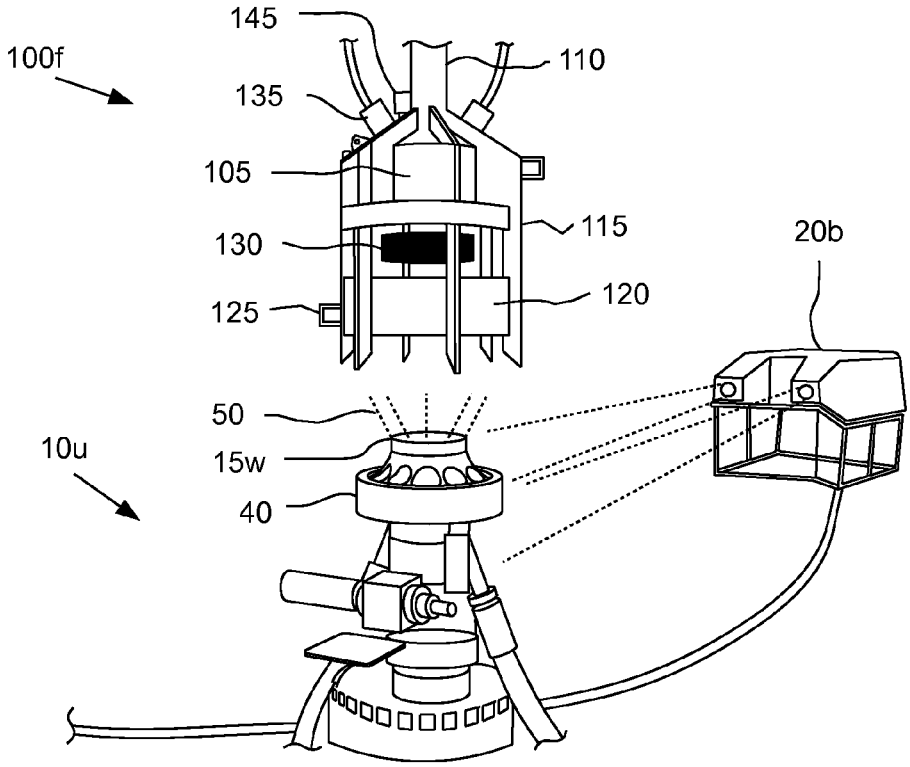
FIGS. 1A and 1B illustrate landing and operation of a face seal collector.
Figure 1B:
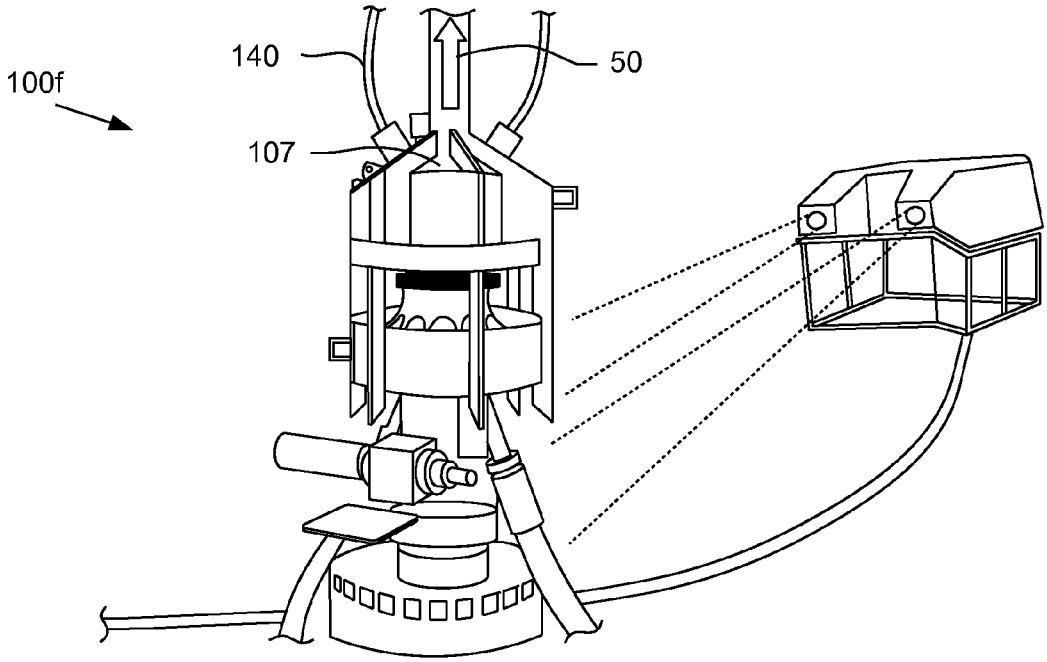

FIGS. 1A and 1B illustrate landing and operation of a face seal collector 100*f*. Depending on the damage to the subsea equipment 10*u,b*, 15*r,d* caused by the blowout 50, the riser 15*r* may be clean cut 15*w* near a top of the LMRP 10*u*, such as near the riser adapter connector 40. If the cut 15*w* is clean, i.e. made with a diamond wire saw, the face seal collector 100 may be employed. The face seal collector 100*f* may include a lower landing guide 120, a frame 115, a housing 105, a seal, such as a grommet 130, a head 107, and the chimney 110. Except for the seal 130, each of the collector members may be connected to one or more of the other members, such as by fastening or welding. Except for the seal 130 and where otherwise specified, the collector members may each be made from a metal or alloy, such as steel, stainless steel, or nickel based alloy. The grommet 130 may be made from a polymer, such as an elastomer, and may be bonded to the housing 105. A lower surface of the grommet 130 may have a sealing surface that is flat, conical, convex, or concave relative to the cut face, or other surface on which it lands.

The lower landing guide 120 may surround the riser adapter 40 and provide lateral support to the collector 100. The lower guide 120 may be annular or conical having a diameter or minor diameter corresponding to a diameter of the riser adapter 40 and have the frame 115 extending along an outer surface and connected thereto. The grommet 130 may engage the riser cut face 15*w* and a weight of the collector 100*f* may be set on the grommet 130, thereby compressing the grommet and providing sealing pressure. The grommet 130 may provide a low pressure seal, such as less than or equal to fifty psig, so that a positive pressure differential (relative to pressure of the sea) may be maintained in a containment chamber formed by the housing 105. The positive pressure may prevent or mitigate entry of seawater into the containment chamber, thereby preventing or controlling gas hydrate formation in the containment chamber. For stabilization and/or workstring support, the collector weight may be substantial, such as greater than or equal to four, five, eight, or ten tons. The weight may be provided by the natural weight of the collector members or weights (not shown) may be added below the grommet, such as at the lower landing guide, to prevent tipping. The workstring 30 may be supported by the MODU 25 in a neutral position with or without heave compensation to prevent buckling of the workstring.

The housing 105 may be tubular and may have a diameter corresponding to the cut face diameter or the housing diameter may be greater than the cut face diameter. The housing 105 may form the containment chamber and may be connected to the head 107 and have the frame 115 extending along an outer surface thereof and connected thereto. The head 107 may be conical to serve as a reducer from the housing diameter to a diameter of the chimney 110. The frame 115 may also extend along and connect to an outer surface of the head 107. The head 107 may have one or more ports formed through a wall thereof and in fluid communication with the containment chamber, such as one or more injection ports 135 and one or more vent ports 145. Alternatively, one or more of the ports may be formed through the housing. The vent ports 145 may be equipped with a subsea connector to allow connection of additional collection conduits, such as hose, drill pipe, or coiled tubing, should it be necessary or desirable to collect and produce additional production fluids. They may also be used to inject gas for gas lift boosting of the produced fluids if necessary. An injection line 140 may connect to each injection port 135 and extend to the MODU 25 or support vessel (not shown). The injection line 140 may be coiled tubing. A first portion of a coupling may be connected to an end of the injection line 140 and a second portion of a coupling may be connected to an inlet of the injection port 135. The coupling may be operable by the ROV, such as a hot stab, to sealingly connect the injection line 140 with the injection port 135. A hydrates inhibitor, such as methanol, ethylene glycol, or propylene glycol, may be injected into the injection ports 135 to prevent or control hydrates formation.

A shutoff valve 347 (FIG. 3A) may be connected to each vent (or collection) port 145. Each shutoff valve 347 may have an actuator operable by an ROV 20*a,b*. The vents 145 may provide fluid communication between the containment chamber and the sea (when the shutoff valves are open). The vents 145 may be opened to facilitate landing of the collector 100*f* on the wellhead 5, if the flow may prevent landing, and then gradually closed as the collector becomes operational. The chimney 110 may be tubular (or other shape), connected to the head 107, and have an upper end of the frame 115 connected thereto. The chimney 110 may have a diameter corresponding to the workstring 30 and structurally and sealingly connect to the workstring, as discussed above. The chimney diameter may be less than or substantially less than the housing diameter.

Once the collector is lowered to the required depth on the workstring 30, an inert gas, such as nitrogen, may be injected through the workstring to displace seawater for prevention of hydrate formation. The inhibitor lines 140 may be connected to the injection ports 135 using the ROV 20*a,b*. Hydrates inhibitor may then be injected into the containment chamber through the inhibitor lines 140. The MODU 25 may then move to the blowing well while continuously injecting the nitrogen and inhibitor. Once near the blowing well, the ROV 20*a,b* may be used to guide the collector 100*f* over the leaking source, such as the cut riser end 15*w*. The collector 100*f* may include one or more ROV handles 125 to facilitate placement and guidance of the collector, since the leaking source may create a plume that obstructs visualization of the collector during placement by ROVs 20*a,b*. An extended ROV handle may allow a better indication of position during placement under such conditions. Once the collector 100*f* is seated, the spewing production fluid may flow through the open vents 145 and/or through the grommet seal cut pipe interface into the sea 1. The nitrogen injection may be halted and an upper end of the workstring 30 may be placed in fluid communication with one or more production facilities, thereby allowing the production fluid to flow through the workstring 30 to the MODU 25. The flow may be facilitated by the density difference between the lighter production fluid and the heavier seawater 1. The ROV 20*a,b* may begin closing the vent valves 347 (if open) of the collector 100*f*. Injection of the hydrates inhibitor may or may not continue after steady state flow is achieved.

If capacity of the production facilities connected to the collector are greater than or equal to the production (blowout) rate of the wellbore, once steady state flow is achieved, all of the vents 145 not connected to collecting units may be closed and the production choke controlled to maintain the positive pressure differential in the containment chamber, such as greater than or equal to one psig. Alternatively, the chamber pressure differential may be less than one psig, such as zero or slightly negative. The chamber pressure differential may depend on seal quality with the leak source (i.e., greater differential for poorer quality to prevent seawater entry and hydrates formation). The production choke may be located at surface or subsea. If subsea, the production choke may be part of the collector 100*f* (i.e., in the chimney 110) or part of the workstring 30 (i.e., part of the workstring adapter 35). Production fluid may flow to the MODU 25 through the workstring 30 and to the production facilities where the production fluid may be separated into crude oil, natural gas, and (produced) water and may flow to additional surface or subsea collecting units. The crude oil may be stored onboard the MODU 25 or transferred to a tanker or supertanker (not shown). The gas may be flared. The water may be stored for later treatment or treated and pumped into the sea.

If collection capacity is less than the production rate of the leak, then one or more vents 145 may remain open to vent the excess production fluid into the sea 1. Alternatively, the vents 145 may be closed and the excess production fluid may leak through the interface between the grommet 130 and the leak source 15*w*. As the leak is collected, the ROV 20*a,b* may visually monitor the collector 100*f* for leakage from the grommet 130. If substantial leakage is observed, the production choke may be adjusted to reduce backpressure on the collector 100*f* to reduce or eliminate the leakage. Minimal leakage may be allowed to ensure positive pressure in the containment chamber, thereby ensuring against seawater entry and hydrates formation.

Additionally, the workstring 30 may be deployed through a riser (not shown) connected to the MODU 25 and a heated fluid, such as sea water, may be pumped through the riser-workstring annulus to discourage formation of hydrates in the production fluid flowing through the workstring. Pumping of the heated seawater may commence when the workstring 30 is connected to the collector 100*f* and continue during steady state production.

Alternatively, the collector 100*f* may be lowered from the MODU 25 using the workstring 30. The collector 100*f* may be connected to the workstring 30 and lowered to the wellhead 5 as the workstring 30 is assembled. Alternatively, a second, different type of collector may be lowered to the seafloor and if the collector is unable to seat on the wellhead, the first collector may be released to the seafloor and the second collector may be connected to the workstring for a second attempt without disassembling the workstring 30.

Figure 1C:
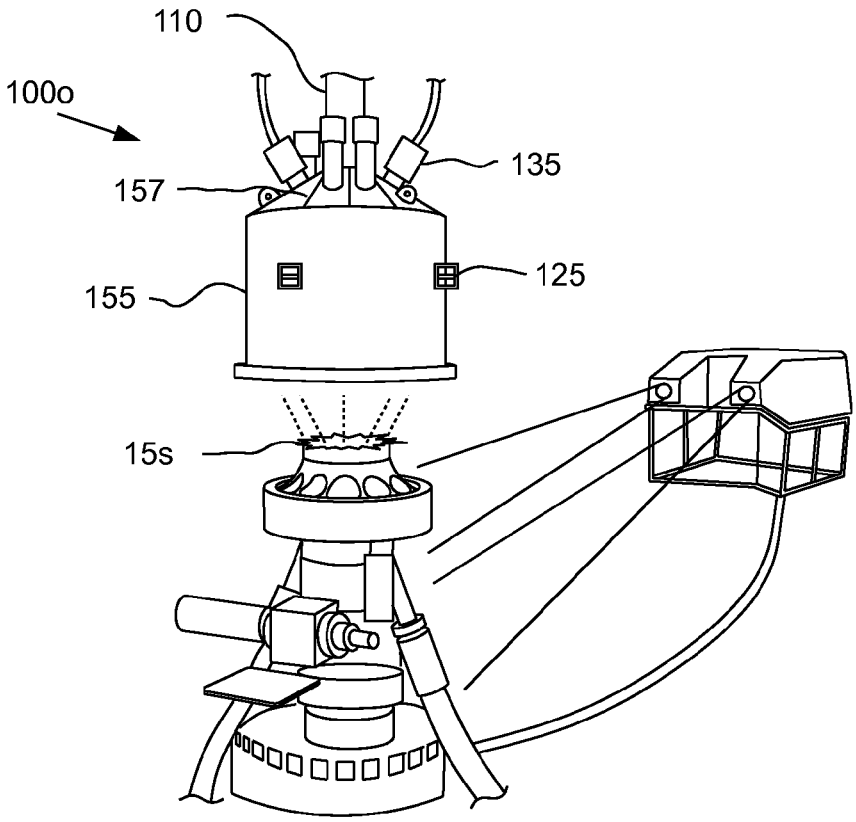
FIGS. 1C and 1D illustrate landing and operation of an overshot collector.
Figure 1D:
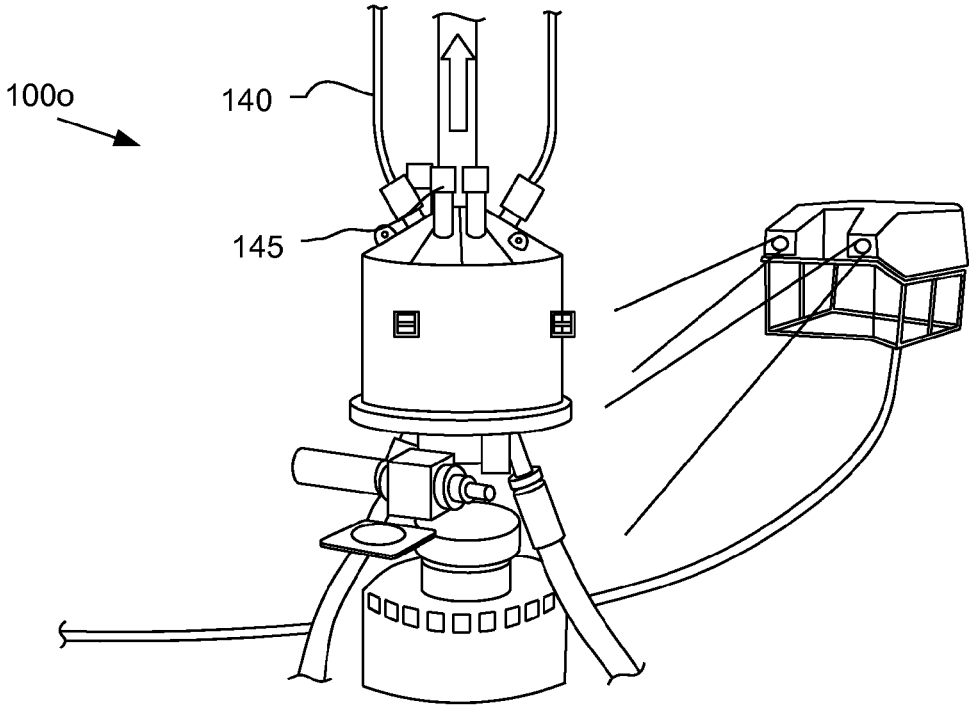

FIGS. 1C and 1D illustrate landing and operation of an overshot collector 100*o*. The overshot collector 100*o* may be similar to the face seal collector 100*f*, discussed above, so only additions and/or differences will be discussed. The housing 155 may be extended and the housing and the head 157 may serve the purpose of the frame and landing guide. The housing 155 may have a landing shoulder (not shown) formed therein for receiving the riser adapter 40 and supporting the weight of the collector therefrom. Instead of the grommet, the housing may have an overshot seal (not shown) or lip seal 630 (FIG. 6B) for engaging an outer surface of the cut riser instead of the cut face 15*s*, thereby eliminating the importance of the cut quality, such as from a hydraulic shear cut. Alternatively, the overshot collector 100*o* may be employed to control leaks on other damaged subsea equipment or seafloor seepage.

Figure 2A:
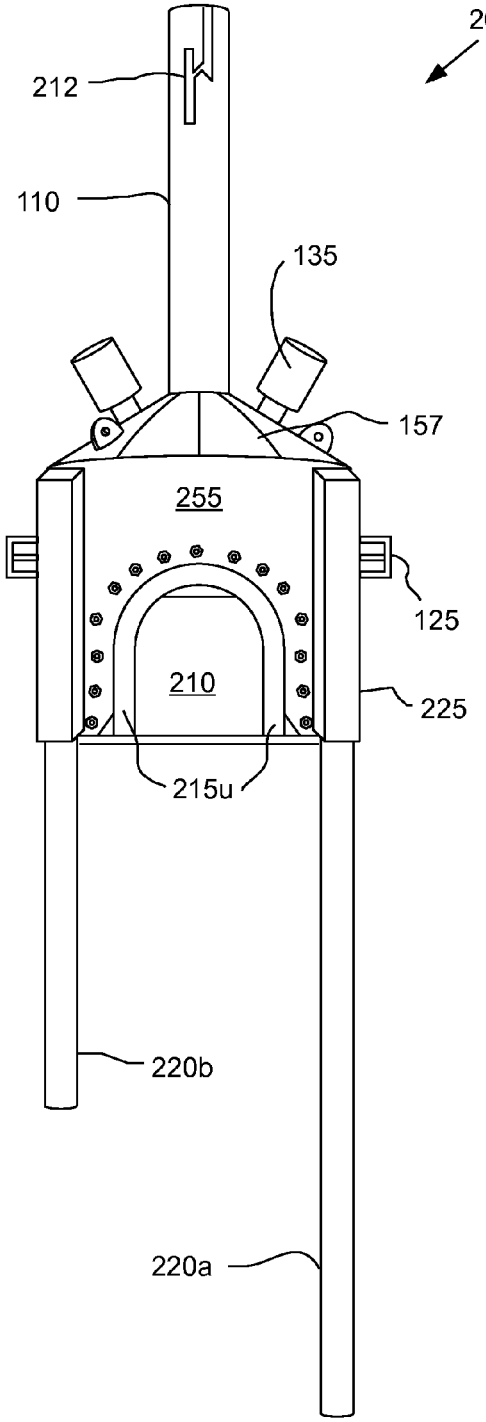
FIGS. 2A and 2B illustrate a side-entry collector for receiving a tubular laying on or near the seafloor, according to another embodiment of the present invention.
Figure 2B:
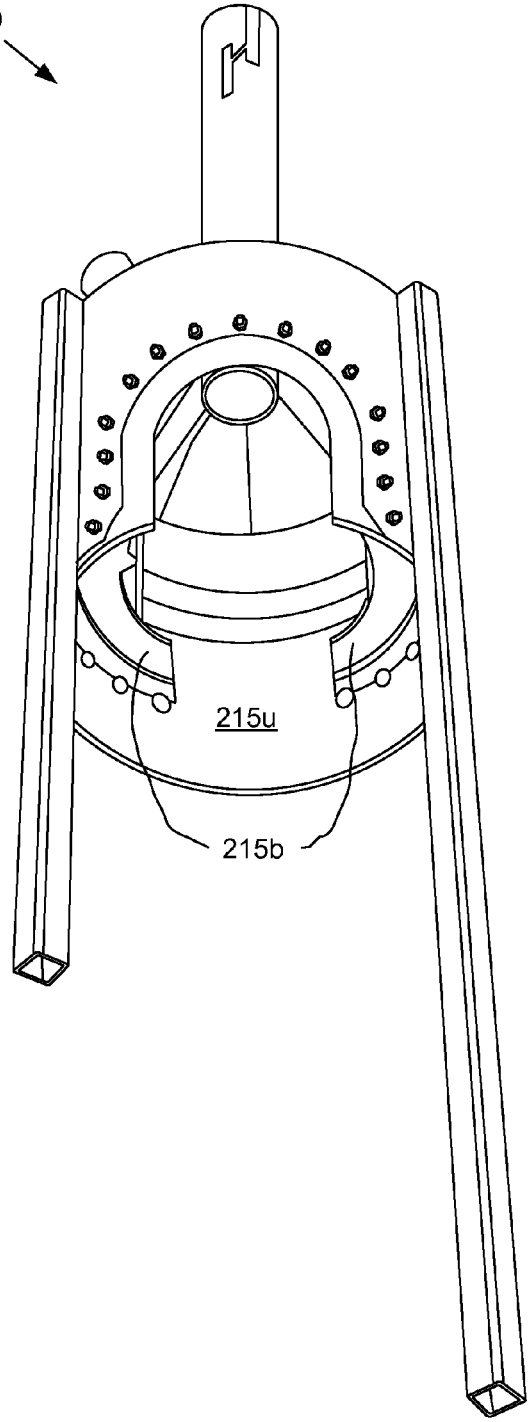

FIGS. 2A and 2B illustrate a side-entry collector 200 for receiving a tubular laying on or near the seafloor, according to another embodiment of the present invention. The tubular may be rigid pipe or flexible tubing, such as a riser, drill pipe, heavy drill pipe, drill collar, production pipeline or umbilical. The side-entry collector 200 may be similar to the overshot collector 100*o*, discussed above, so only additions and/or differences will be discussed. In some instances, it may not be desirable to cut the tubular or the side-entry collector 200 may be deployed as a stopgap until the tubular is cut. The side-entry collector 200 may be deployed over an end of the tubular lying on or near the seafloor.

Instead of an overshot seal, the side-entry collector may include a doorway 210 formed through a wall of the housing 255, an upper seal 215*u* lining the doorway and extending around an inner surface of the housing proximate the doorway, and a lower seal 215*b* extending inward from an inner surface of the housing. The doorway 210 may have a semi-oval shape for receiving the end of the tubular. A size of the doorway 210 may correspond to a diameter of the tubular. The upper seal 215*u* may be bonded or fastened to the housing 255 and a doorway portion of the upper seal may engage an upper portion of the tubular outer surface as the doorway 210 is lowered over the tubular end. The lower seal 215*b* may engage a lower portion of the tubular outer surface as the doorway 210 is lowered over the tubular end. The upper and lower seals 215*u,b* may be separate seals or integral portions of the same seal. As with the grommet and overshot seals, the upper 215*u* and lower 215*b* seals may form a low pressure barrier between the containment chamber and the sea when the collector 200 is engaged with the tubular end. Engagement of the bottom of the housing 255 with the seafloor if may also serve as part of the barrier. Alternatively, the upper seal 215*u* may extend from a bottom of the housing 255 to engage the seafloor 1*f*. Additionally, sealant (not shown), such as mud, gravel, or sand bags, may be dumped on and/or around the side-entry collector 200 to enhance the sealing.

The side-entry collector 200 may further include legs 220*a,b* extending through respective lugs 225 formed in or connected to an outer surface of the housing. The legs 220*a,b* may be fastened to the lugs by ROV operable fasteners. One of the legs 220*a* may be longer or substantially longer than the other leg 220*b*. The side-entry collector 200 may be deployed until the doorway 210 is proximate to the leak source but clear from the spewing plume of production fluid. The ROV 20*a,b* may disengage the longer leg fastener, thereby extending the longer leg 220*a* into the seafloor 1*f*. Once the longer leg 220*a* is set, the collector 200 may then be rotated about the set leg 220*a* and lowered onto the leak source. The shorter leg 220*b* may then be set. Engagement of the legs 220*a,b* with the seafloor if may serve to laterally stabilize the collector 200 and facilitate precise positioning of the collector relative to the leak source. The vents and shutoff valves may be omitted from the side-entry collector. Alternatively, the side-entry collector may include the vents (or collection ports) and shut-off valves.

Alternatively, the overshot collector 100*o* may be deployed horizontally over the tubular end instead of using the side-entry collector 200. Alternatively, the doorway 210 may be omitted and the modified collector employed to control seafloor seepage due to casing failure by penetrating the seafloor 1*f* and sealing around the leak source.

Figure 3A:
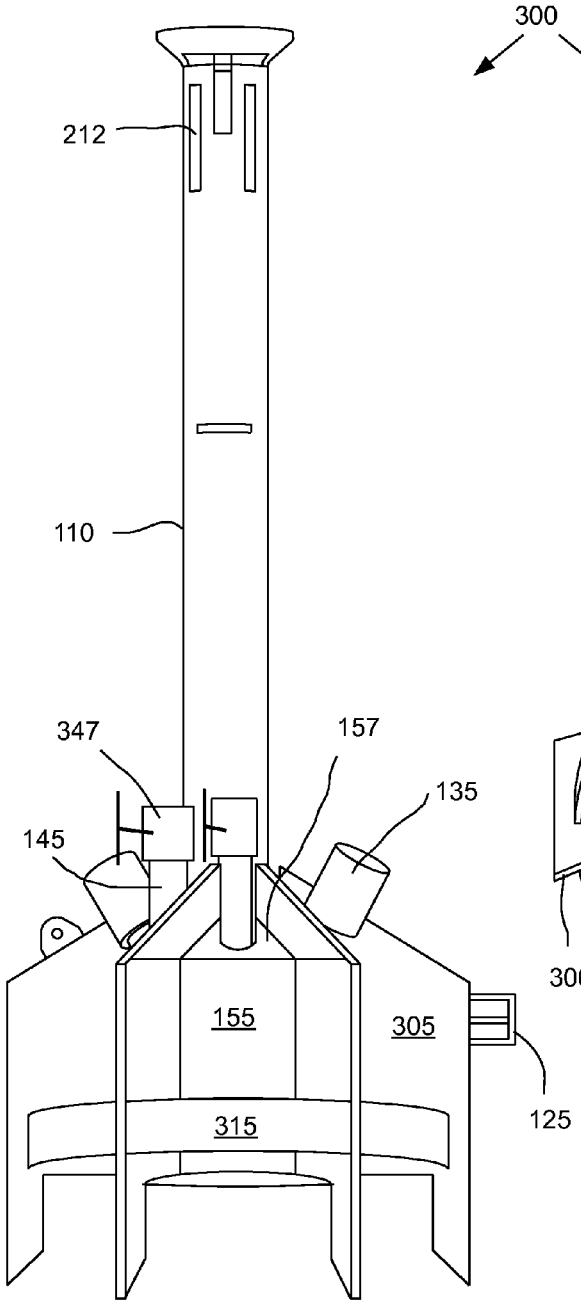
FIGS. 3A and 3B illustrate a siphon seal overshot collector, according to another embodiment of the present invention.
Figure 3B:
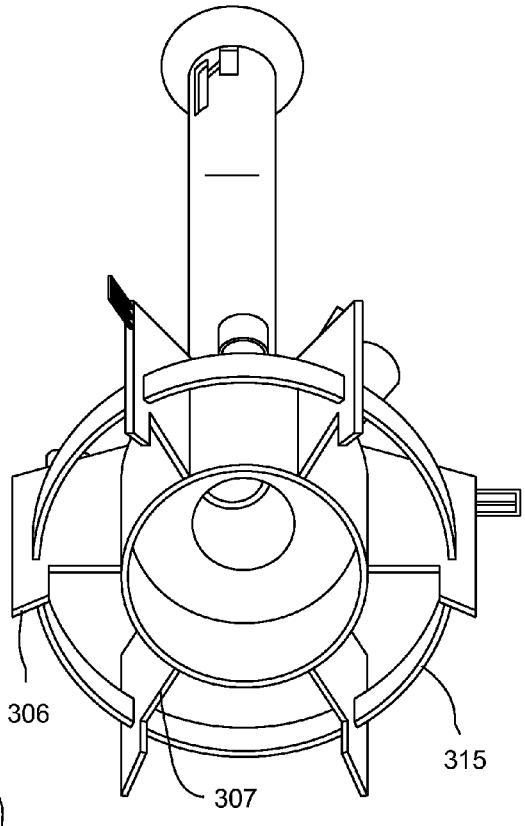

FIGS. 3A and 3B illustrate a siphon or plumber seal overshot collector 300, according to another embodiment of the present invention. The siphon seal may be upside down and may take advantage of the density difference between the production fluid 50 and seawater 1. The siphon seal collector 300 may be similar to the overshot collector 100*o*, discussed above, so only additions and/or differences will be discussed. The overshot seal may be omitted from the siphon seal collector 300. The siphon seal collector 300 may include a landing frame for engaging the subsea connector, i.e., the riser adapter 40, and longitudinally supporting the collector 300 therefrom. The landing frame may include two or more landers 305. Each lander 305 may have a stab portion 306 and a landing shoulder 307. The landers 305 may be reinforced by a support ring 315. An inner diameter of the housing 155 may correspond to an outer diameter of the cut riser 15*s* to form an additional controlled gap seal therebetween to minimize leakage from the containment chamber to the sea 1. The elastomeric lip seal 630 may be added to provide additional sealing and configured to act like a pressure release valve to prevent lifting of the collector. As discussed above, maintenance of the positive pressure differential ensures that the collected fluid is production fluid from the containment chamber and not sea water 1 into the containment chamber.

Figure 4:
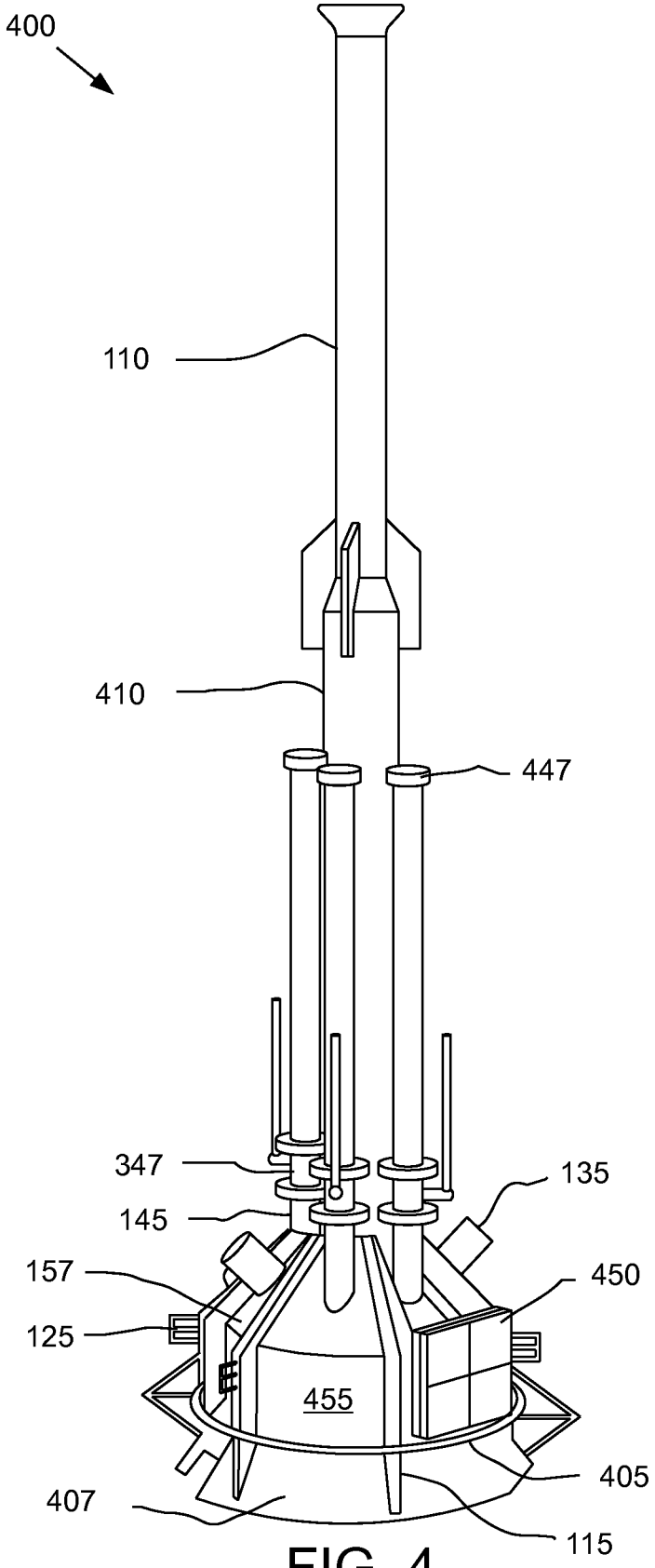
FIG. 4 illustrates an overshot collector having a drill string receiver, according to another embodiment of the present invention.

FIG. 4 illustrates an overshot collector 400 having a drill string receiver 410, according to another embodiment of the present invention. The overshot receiver collector 400 may be similar to the overshot collector 100*o*, discussed above, so only the additions and/or differences will be discussed. In some instances, instead of cutting the riser 15*r*, it may be possible to remove the LMRP 10*u*. Removing the LMRP 10*u* may expose a connector profile in the top of the BOP stack 10*b*. Removing the LMRP 10*u* may also leave a section of the drill string 15*d* extending from the BOP stack 10*b* or the drill string may be cut or unthreaded leaving a portion extending from the BOP stack.

The overshot receiver collector 400 may include the drill string receiver 410 disposed between the chimney 110 and the housing 455 for accommodating the extending drill string portion. The overshot receiver collector 400 may further include a frame 115 extending from the landing shoulder 407, along an outer surface of the housing 455, and to the receiver 410 and connected thereto for structural reinforcement. The landing shoulder 407 may be a conical lower portion of the housing 455. The overshot receiver collector 400 may further include one or more landing pads 506 (FIG. 5C) lining an inner surface of the landing shoulder 407 to protect the connector profile from damage. The pads 506 may be made from a polymer, such as a thermoplastic or coploymer, such as polyoxymethylene (POM). Each pad 506 may be connected to the shoulder 407 by one or more fasteners. Heads of the fasteners may be received in respective recesses formed in an inner surface of the pads 506 to prevent the fastener heads from damaging the connector profile.

The overshot receiver collector 400 may further include a control panel 450. The control panel 450 may include one or more dispersant injection ports, a shutoff valve connected to each port for opening and closing the ports, and an ROV operable actuator for opening and closing the shutoff valves. The shutoff valve actuator may be operable by an ROV. A single actuator may control both valves or the panel may include first and second actuators for respective valves. Alternatively, a three-way valve may replace the shutoff valves 347 or a single port may be used with a diverter valve. A dispersant injection line extending from the MODU 25 may be connected to each port using an ROV operable connector, similar to the injection port connector discussed above. A manifold may lead from one of the dispersant injection ports and conduits may be connected to the manifold. Each conduit may be in communication with a respective vent 145, such as downstream of the vent shutoff valves 347. Alternatively, each conduit may connect to the respective vent 145 upstream of the vent shutoff valve 347. The other dispersant injection port may be connected by a conduit to a sprayer, such as a ring 405, connected to the frame. The dispersant ring 405 may have outlets, such as orifices or nozzles, spaced therearound for discharging the dispersant toward the landing shoulder 407.

In operation, during startup, the dispersant may be injected into the vents 145 at a flow rate based on the flow rate of production fluid venting into the sea 1. Once steady state operation is achieved, the dispersant may be injected into the dispersant ring 405 based on the amount of leakage occurring through the seal (if any).

A check valve, such as a flapper valve 447, may be connected to an outlet of each vent 145 to allow flow of production fluid therethrough and prevent reverse flow of seawater 1. Similar to the overshot collector 100*o*, the receiver collector 400 may include one or more injection ports 135 in communication with the containment chamber. An injection line 140 may connect each injection port 135 to the MODU 25. Alternatively, each injection port may connect to a port formed in the control panel 450.

Figures 5A, 5B, 5C:
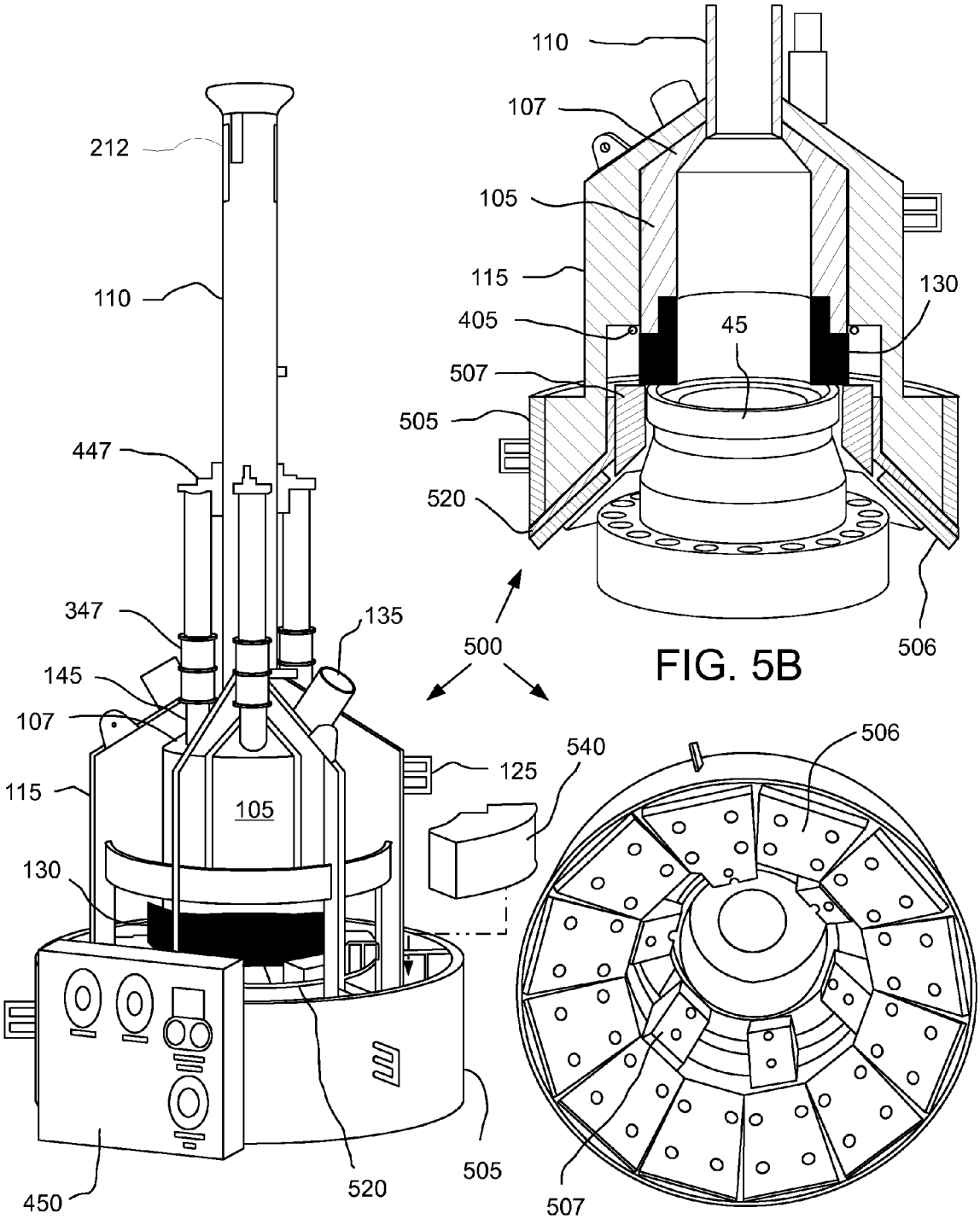
FIGS. 5A-5C illustrate a face seal collector for a subsea connector, according to another embodiment of the present invention.

FIGS. 5A-5C illustrate a face seal collector 500 for a subsea connector, according to another embodiment of the present invention. The subsea connector face seal collector 500 may be similar to the face seal collector 100*f*, discussed above, so only the additions and/or differences will be discussed. In some instances, instead of cutting the riser 15*r*, it may be possible to remove the riser adapter 40 from the LMRP 10*u* using an emergency riser disconnect (EMRD) of the LMRP. Removing the riser adapter may expose a profile 45 of the EMRD and a seal face suitable for the grommet 130. Alternatively, the subsea connector face seal collector 500 may be configured to land on the LMRP connector profile, the wellhead connector profile, a connector profile of the BOP stack or any other connector profile of the LMRP or BOP stack be it quick connect or flanged.

The landing guide 520 of the subsea connector face seal collector may include a conical portion and a tubular portion. The conical portion may facilitate landing on the EMRD profile 45 and include one or more landing pads 506, similar to the landing pads of the drill string receiver overshot collector discussed above, for protecting the connector profile. One or more guide pads 507 may be connected to the tubular portion, such as with fasteners, to engage an outer surface of the EMRP profile 45, thereby providing lateral stabilization. The subsea connector face seal collector 500 may further include a support ring 505 aligned with the landing guide 520 and having a diameter corresponding to a major diameter of the conical portion. An annulus may be defined between the support ring 505 and the landing guide 520. The frame 115 may extend into the annulus and be connected to the landing guide 520 and the support ring 505. One or more weights 540 made from a heavy material, such as lead, may be disposed in the annulus for workstring support and/or stabilization by lowering the center of gravity (in some cases below the grommet 130), as discussed above.

The subsea connector face seal collector 500 may further include additional features similar to the drill string receiver overshot collector 400, such as the control panel 450, the vent check valves 447, and the dispersant ring 405. Alternatively, the subsea connector face seal collector 500 may include the siphon seal and/or the lip seal 630, discussed above, in addition to the grommet 130 by closing the annulus formed between the grommet 130 and the frame 115 (dispersant ring 405 may be moved or omitted).

Figure 6A:
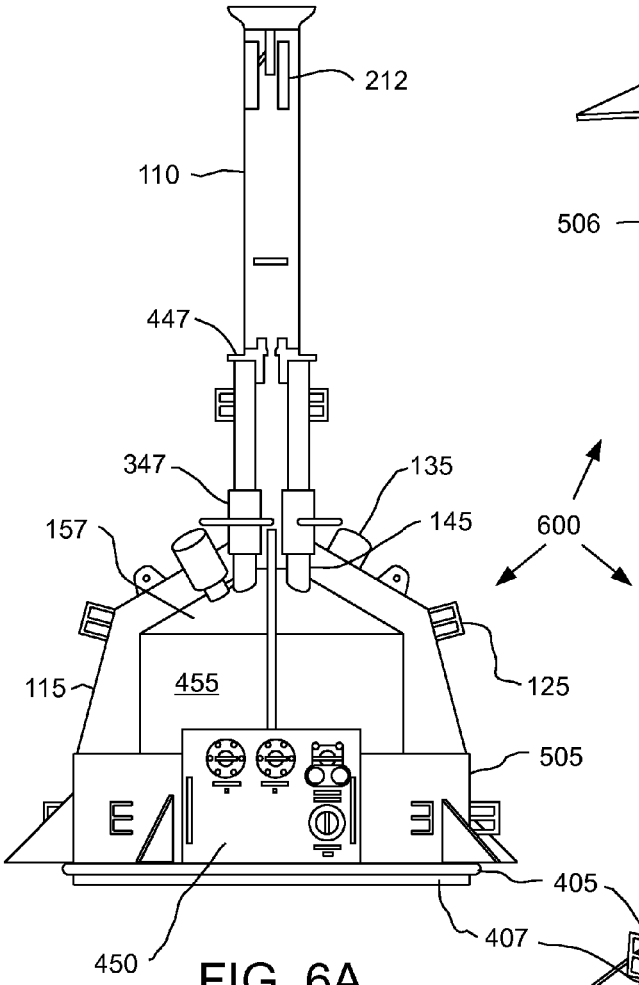
FIGS. 6A-6C illustrate an overshot collector for a subsea flange, according to another embodiment of the present invention.
Figure 6B:
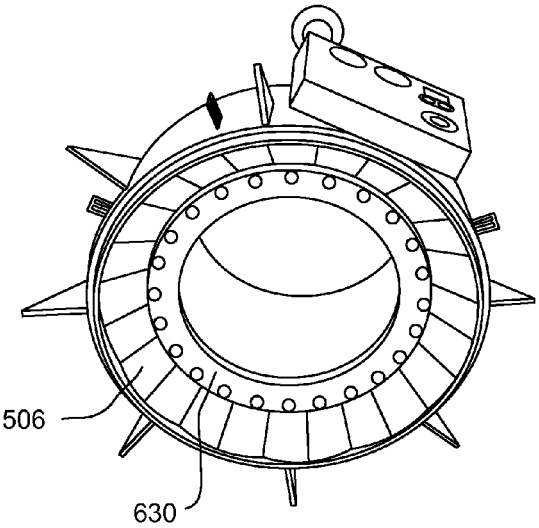
Figure 6C:
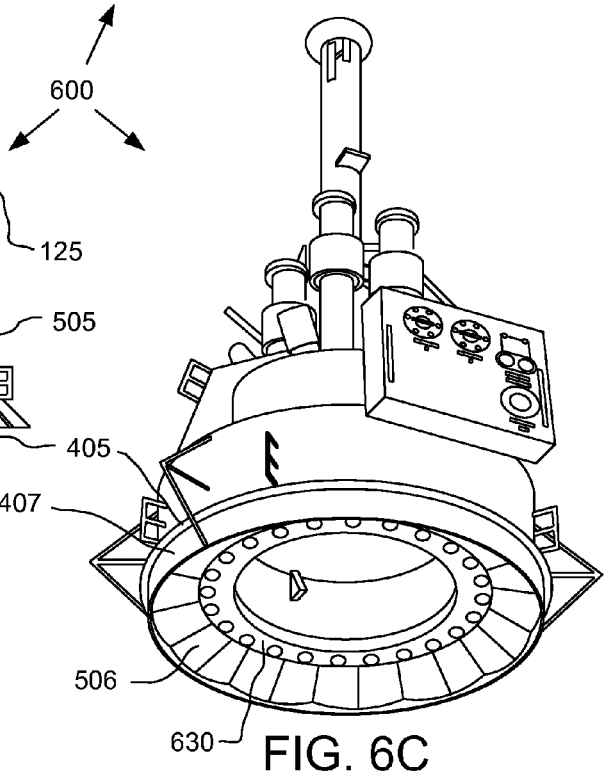

FIGS. 6A-6C illustrate an overshot collector 600 for a subsea flange, according to another embodiment of the present invention. The overshot flange collector 600 may be similar to the overshot receiver collector 400, discussed above, so only the additions and/or differences will be discussed. In some instances, instead of cutting the riser 15*r*, it may be possible to remove a portion of a flanged joint of the LMRP 10*u* or BOP stack 10*b* using the ROV 20*a,b*. Alternatively, the overshot flange collector 600 may be configured to engage a flange joint of a subsea production tree.

Relative to the overshot receiver collector 400, the drill string receiver may be omitted and the housing 455 may have an inner diameter corresponding to an outer diameter of the flange joint. The lip seal 630 may have a diameter corresponding to the flange joint diameter for engaging the flange joint. The overshot flange collector 600 may further include additional features similar to the subsea connector face seal collector, such as the support ring 505 and weights.

Alternatively, the vents and vent shutoff valves may be omitted from any of the collectors, discussed above. Additionally, a pump may be added to the workstring or any of the collectors to facilitate collection of the production fluid. The pump may be an electrical submersible pump (ESP).

While the foregoing is directed to embodiments of the present invention, other and further embodiments of the invention may be devised without departing from the basic scope thereof, and the scope thereof is determined by the claims that follow.

The invention claimed is:

1. A collector for capturing flow discharged from a subsea blowout, comprising:
- a tubular housing having a containment chamber;
- a face seal connected to a lower portion of the housing for engaging an existing profile of or cut made into a lower marine riser package;
- a tubular chimney having a portion of a subsea connector, and having a diameter less than a diameter of the containment chamber;
- a head connecting the housing and the chimney and having a vent port and an injection port, each port formed through a wall thereof and in fluid communication with the containment chamber;
- a shutoff valve connected to the vent port;
- a coupling connected to the injection port for receiving an injection line;
- a frame extending along an outer surface of the housing and the head;
- a conical landing guide connected to or formed into a lower portion of the frame; and
- one or more pads connected to an inner surface of the landing guide.

2. The collector of claim 1, wherein the seal has a diameter corresponding to the chamber diameter.

3. The collector of claim 1, further comprising a sprayer ring located adjacent to the seal and having outlets spaced therearound.

4. The collector of claim 3, further comprising a control panel operable by a remotely operated vehicle (ROV), the control panel having a port in fluid communication with the sprayer ring.

5. The collector of claim 1, further comprising:
- a support ring connected to the landing guide and having a diameter corresponding to a major diameter of the landing guide;
- a solid weight disposed in an annulus formed between the support ring and the landing guide.

6. The collector of claim 1, further comprising a check valve allowing flow from the chamber through the vent port and preventing reverse flow from the vent port into the chamber.

7. The collector of claim 6, wherein the vent port is equipped with a connector that permits connection of an additional collection conduit.

8. A collector for capturing flow discharged from a subsea blowout, comprising:
- a tubular housing having a containment chamber;
- a solid overshot or lip seal connected to a lower portion of the housing for engaging an outer surface of a lower marine riser package or blowout preventer;
- a tubular chimney having a portion of a subsea connector and having a diameter less than a diameter of the containment chamber;
- a head connecting the housing and the chimney and having a vent port and an injection port, each port formed through a wall thereof and in fluid communication with the containment chamber;
- a shutoff valve connected to the vent port;
- a coupling connected to the injection port for receiving an injection line; and
- a frame extending along an outer surface of the housing and the head,
- wherein the seal has a diameter greater than the chamber diameter.

9. The collector of claim 8, further comprising:
- a conical landing guide connected to or formed into a lower portion of the frame; and
- one or more pads connected to an inner surface of the landing guide.

10. The collector of claim 9, further comprising a sprayer ring connected to the landing guide and having outlets spaced therearound.

11. The collector of claim 10, further comprising a control panel operable by a remotely operated vehicle (ROV), the control panel having a port in fluid communication with the sprayer ring.

12. The collector of claim 9, further comprising:
- a support ring connected to the landing guide and having a diameter corresponding to a major diameter of the landing guide; and
- a solid weight disposed in an annulus formed between the support ring and the landing guide.

13. The collector of claim 8, further comprising a check valve allowing flow from the chamber through the vent port and preventing reverse flow from the vent port into the chamber.

14. The collector of claim 13, wherein the vent port is equipped with a connector that permits connection of an additional collection conduit.

15. The collector of claim 8, further comprising a drill string receiver disposed between the chimney and the head.

16. A collector for capturing flow discharged from a subsea blowout, comprising:
- a tubular housing having a containment chamber and a doorway formed in a side thereof for receiving an end of a tubular laying on or near the a floor of the sea;
- an outer seal lining the doorway for engaging an upper portion of the tubular end;
- an inner seal extending inward from an inner surface of the housing for engaging a lower portion of the tubular end;
- a tubular chimney having a portion of a subsea connector and having a diameter less than a diameter of the containment chamber;

a head connecting the housing and the chimney and having an injection port formed through a wall thereof and in fluid communication with the containment chamber;

a coupling connected to the injection port for receiving an injection line;

lugs connected to an outer surface of the housing; and a leg for fastening to each frame and for engaging the seafloor to stabilize the collector therefrom.

17. The collector of claim 16, wherein one of the legs is substantially longer than the other leg to facilitate positioning of the collector about the tubular end.

18. The collector of claim 16, wherein the outer seal extends around the housing inner surface.

19. A collector for capturing flow discharged from a subsea blowout, comprising:

a tubular housing having a containment chamber;

a seal connected to the housing;

a tubular chimney connected to the housing, having a portion of a subsea connector, and having a diameter less than a diameter of the containment chamber;

a head connected to the housing and the chimney;

a conical landing guide connected to or formed into a lower portion of the housing;

one or more pads connected to an inner surface of the landing guide;

a sprayer ring connected to the landing guide and having outlets spaced therearound; and a control panel operable by a remotely operated vehicle (ROV), the control panel having a port in fluid communication with the sprayer ring.

20. A collector for capturing flow discharged from a subsea blowout, comprising:

a tubular housing having a containment chamber;

a face seal connected to a lower portion of the housing for engaging an existing profile of or cut made into a lower marine riser package;

a tubular chimney having a portion of a subsea connector, and having a diameter less than a diameter of the containment chamber;

a head connecting the housing and the chimney and having a vent port and an injection port, each port formed through a wall thereof and in fluid communication with the containment chamber;

a shutoff valve connected to the vent port;

a coupling connected to the injection port for receiving an injection line;

a frame extending along an outer surface of the housing and the head; and a sprayer ring located adjacent to the seal and having outlets spaced therearound.

21. The collector of claim 20, further comprising a control panel operable by a remotely operated vehicle (ROV), the control panel having a port in fluid communication with the sprayer ring.

22. A collector for capturing flow discharged from a subsea blowout, comprising:

a tubular housing having a containment chamber;

a face seal connected to a lower portion of the housing for engaging an existing profile of or cut made into a lower marine riser package;

a tubular chimney having a portion of a subsea connector, and having a diameter less than a diameter of the containment chamber;

a head connecting the housing and the chimney and having a vent port and an injection port, each port formed through a wall thereof and in fluid communication with the containment chamber;

a shutoff valve connected to the vent port;

a coupling connected to the injection port for receiving an injection line;

a frame extending along an outer surface of the housing and the head; and a check valve allowing flow from the chamber through the vent port and preventing reverse flow from the vent port into the chamber.

23. The collector of claim 22, wherein the vent port is equipped with a connector that permits connection of an additional collection conduit.

24. A collector for capturing flow discharged from a subsea blowout, comprising:

a tubular housing having a containment chamber;

a solid overshot or lip seal connected to a lower portion of the housing for engaging an outer surface of a lower marine riser package or blowout preventer;

a tubular chimney having a portion of a subsea connector and having a diameter less than a diameter of the containment chamber;

a head connecting the housing and the chimney and having a vent port and an injection port, each port formed through a wall thereof and in fluid communication with the containment chamber;

a shutoff valve connected to the vent port;

a coupling connected to the injection port for receiving an injection line;

a frame extending along an outer surface of the housing and the head;

a conical landing guide connected to or formed into a lower portion of the frame; and one or more pads connected to an inner surface of the landing guide.

25. The collector of claim 24, further comprising a sprayer ring connected to the landing guide and having outlets spaced therearound.

26. The collector of claim 25, further comprising a control panel operable by a remotely operated vehicle (ROV), the control panel having a port in fluid communication with the sprayer ring.

27. The collector of claim 24, further comprising:

a support ring connected to the landing guide and having a diameter corresponding to a major diameter of the landing guide; and a solid weight disposed in an annulus formed between the support ring and the landing guide.

28. A collector for capturing flow discharged from a subsea blowout, comprising:

a tubular housing having a containment chamber;

a solid overshot or lip seal connected to a lower portion of the housing for engaging an outer surface of a lower marine riser package or blowout preventer;

a tubular chimney having a portion of a subsea connector and having a diameter less than a diameter of the containment chamber;

a head connecting the housing and the chimney and having a vent port and an injection port, each port formed through a wall thereof and in fluid communication with the containment chamber;

a shutoff valve connected to the vent port;

a coupling connected to the injection port for receiving an injection line;

a frame extending along an outer surface of the housing and the head; and a check valve allowing flow from the chamber through the vent port and preventing reverse flow from the vent port into the chamber.

29. The collector of claim 28, wherein the vent port is equipped with a connector that permits connection of an additional collection conduit.

30. A collector for capturing flow discharged from a subsea blowout, comprising:

a tubular housing having a containment chamber;

a solid overshot or lip seal connected to a lower portion of the housing for engaging an outer surface of a lower marine riser package or blowout preventer;

a tubular chimney having a portion of a subsea connector and having a diameter less than a diameter of the containment chamber;

a head connecting the housing and the chimney and having a vent port and an injection port, each port formed through a wall thereof and in fluid communication with the containment chamber;

a shutoff valve connected to the vent port;

a coupling connected to the injection port for receiving an injection line;

a frame extending along an outer surface of the housing and the head; and a drill string receiver disposed between the chimney and the head.

* * * * *

UNITED STATES PATENT AND TRADEMARK OFFICE

CERTIFICATE OF CORRECTION

PATENT NO. : 8,931,562 B2
APPLICATION NO. : 13/237549
DATED : January 13, 2015
INVENTOR(S) : Cargol, Jr. et al.

It is certified that error appears in the above-identified patent and that said Letters Patent is hereby corrected as shown below:

In Claims:

Column 10, Claim 16, Line 60, please delete "the" before a.

Signed and Sealed this
Thirtieth Day of June, 2015

Michelle K. Lee

Michelle K. Lee
*Director of the United States Patent and Trademark Office*